United States Patent [19]

Tokuzumi

[11] 4,252,356

[45] Feb. 24, 1981

[54] BAG FOR PACKAGING ANIMAL'S DROPPINGS

[76] Inventor: Yoshihiko Tokuzumi, 22-14, Okuzawa 1-chome, Setagaya-ku, Tokyo 158, Japan

[21] Appl. No.: 90,962

[22] Filed: Nov. 5, 1979

[30] Foreign Application Priority Data

Nov. 5, 1978 [JP] Japan ..... 53-151906[U]

[51] Int. Cl.[3] ..... A01K 29/00

[52] U.S. Cl. ..... 294/1 B

[58] Field of Search ..... 294/1 B, 1 BA, 1 BB, 294/16, 55; 15/104.8, 257.1, 257.6, 257.9; 229/53, 55, 62

[56] References Cited

U.S. PATENT DOCUMENTS 3,739,418 6/1973 Yonaites et al. ..... 294/1 B 3,978,540 9/1976 Peck et al. ..... 294/1 B

FOREIGN PATENT DOCUMENTS 1018117 9/1977 Canada ..... 294/1 B

*Primary Examiner*—James B. Marbert

*Attorney, Agent, or Firm*—Karl W. Flocks

[57] ABSTRACT

A bag for packaging animal's droppings comprising a bag body and a scooper board secured thereto. The bag body is made of relatively flexible material, and the scooper board is made of relatively hard material so as to ladle the droppings on the ground. The scooper board comprises a guide portion for ladling the droppings and hold portions for having the bag packaging the dropping in hand, and this scooper board is turnably secured to one edge of the opening of the bag body in the manner that the guide portion is upwardly. Because the scooper board can turn, the guide portion thereof can enter in the bag body only by turning the scooper board. So the user of the bag can settle the animal's droppings by operating the bag sanitarily.

3 Claims, 4 Drawing Figures

BAG FOR PACKAGING ANIMAL'S DROPPINGS

BACKGROUND OF THE INVENTION

The present invention relates to a bag for gathering and packaging animal's droppings. There have been several undesirable problems relative to sanitation which have occurred from non-settlement of the droppings of animal's such as dogs during a walk. The main reason of the above problem is that there are no implements which are portable, sanitary and easy to operate.

On prior days, a person who takes a walk with his pet such as a dog had to carry some sheets of paper or some paper bags and a shovel for settling the dog's droppings. However, it was fairly troublesome for him to carry such implements, so he often left them at home and didn't settle the dog's droppings.

The object of the present invention is to provide a bag for packaging droppings of animals which is portable, santiary and easy to operate.

SUMMARY OF THE INVENTION

The bag of the present invention comprises a bag body made of flexible material such as paper or the like and a dropping scooper board mounted on one edge of the mouth (or opening) of said bag body. This dropping scooper board is constructed from a foldable plate member made of relatively hard material such as pasteboard, plastic or thin wood. Said scooper board is usually secured on the mouth of the bag body unfolded, and has a guide portion which extends (or projects) upwardly of the mouth. The guide portion of said scooper board is used so as to take the gathered droppings into the bag. In order to gather the animal's droppings, a spatula is preferablly attached to the bag as an accessory. The scooper board can be turned about the securing portion, so the guide portion thereof turns into the bag body and the droppings put on the guide portion drop into the bag body.

When the scooper board has turned, the hold portion of the scooper board now extends upwardly of the mouth of the bag body. An user folds up this hold portion at the folding line and can close the mouth of the bag body in which the droppings are packaged. At the edge of the mouth of the bag opposite the scooper board, a binding means for example, a strip, adhesive or non-adhesive tape or the like is provided, which closes and clamps the mouth of the bag body tightly by engaging with the clamping portion. Thus, the user or operator can take away the droppings to his home or a place suitable for dumping the bag. The preferred embodiment of the present invention will be explained with reference to the drawings.

DETAILED DESCRIPTION OF THE PREFERRED EMBODIMENT

Figure 1:
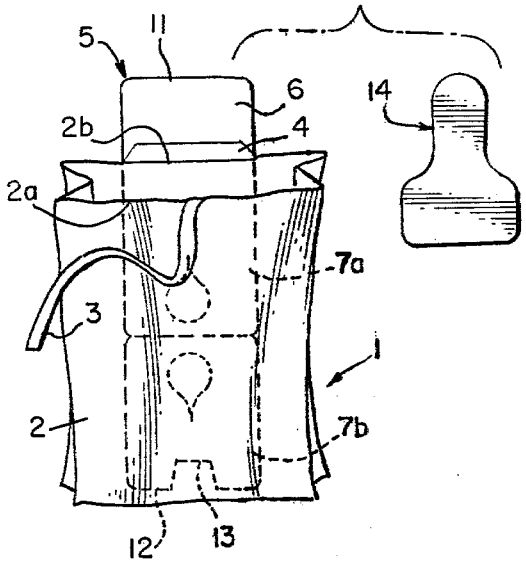
FIG. 1 is a perspective view of the bag of the present invention in which the scooper board is not turned yet.

As shown in FIG. 1 the bag 1 for packaging animal's droppings comprises a bag body 2 preferably made of opaque material such as paper or vinyl. On the mouth edge 2*a* of the bag body 2, a binding means 3 such as a tape or a strip is mounted and the mouth of the bag body 2 is opened and closed when the dropping is settled by pulling and clamping the binding means. On the edge of the mouth 2*b* opposite the edge 2*a* where the binding means 3 is mounted, a fixing part 4 is formed in order to secure a dropping scooper board 5. The scooper board 5 has a dropping guide portion 6 in order to take the droppings into the bag easily, and a hold portions 7*a* and 7*b* which are held by the user after he takes the droppings into the bag body 2. Holes for holding 8*a* and 8*b* are preferably formed at the suitable part of each of the hold portions 7*a* and 7*b* so as to enable the user to hold the bag 1 easily, and further slotted clamping portions 9*a* and 9*b* are formed contiguously to the holes. A cutting 13 is formed at the end 12 of the hold portion 7*b* so that the binding means 3 can engage with the clamping portions 9*a* and 9*b* smoothly when the bag body 2 is closed. The scooper board 5 has a folding line 10 between the hold portions 7*a* and 7*b* so as to make the holes 8*a* and 8*b* accord with each other (See FIG. 3) when the scooper board 5 is folded at the folding line 10 after the droppings are packed in the bag body 2.

The length of the scooper board 5 is similar to or otherwise a little longer than that of the bag body 2. The reason is that if the scooper board 5 has the above size, the operator (user) opening the mouth of the bag 1 by pulling the binding means 3 mounted on the side 2*a* of the mouth can at the same time freely move the guide portion 6 of the scooper board 5 forward and rearward by pushing and pulling the end 12 of the hold portion 7*b* of the scooper board 5. The scooper board 5 should have some hardness in order to supporting the gathered droppings and take them into the bag 1 easily, so the scooper board 5 is made of relatively hard material such as pasteboard or plastic.

Figure 2:
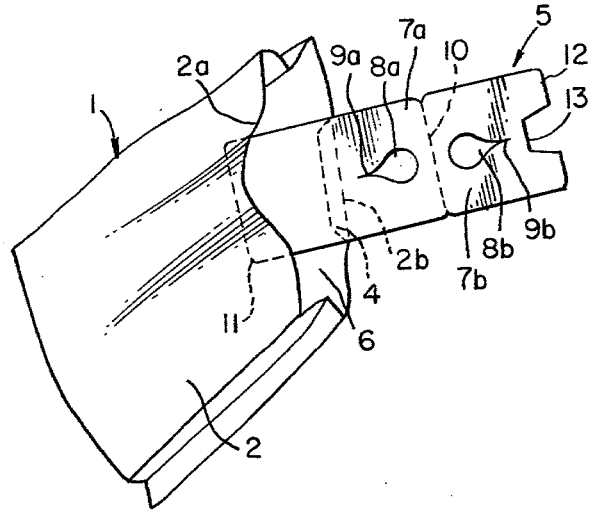
FIG. 2 is a perspective view similar to FIG. 1, in which the scooper board is turned up.

As shown in FIG. 2, the scooper board 5 is secured to the fixing part 4 formed at the edge 2*b* of the mouth, and this scooper board can turn 180° about said fixing part. This turning operation of the scooper board 5 can be obtained by mounting the scooper board on the edge 2*b* through the fixing part 4 constructed from a foldable material.

On using the bag 1 of the present invention, it is necessary that the operator holds the spatula 14 which is attached to the bag as an accessory or which he carries separately with him. When the operator holds the binding means 3 mounted on the edge 2*a* and picks the bag 1 up, the mouth of the bag body 2 automatically opens under the weight of the scooper board 5 secured to the opposite edge 2*b*. Then the operator fixes the binding means 3 to his fingers of one hand, grips the end 12 of the hold portion 7*b* of the scooper board in the condition that the mouth opens, pushes the scooper board 5 so as to make the distal end 11 thereof get near to the droppings, and takes the droppings into the bag body 2 by the spatula 14 having in the other hand. When the droppings are settled and packaged in the bag body, the spatula is also taken into the bag body.

Figure 3:
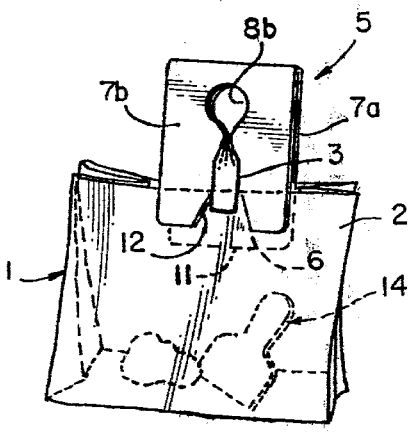
FIG. 3 is a perspective view of the bag of the present invention in which the droppings are packed.
Figure 4:
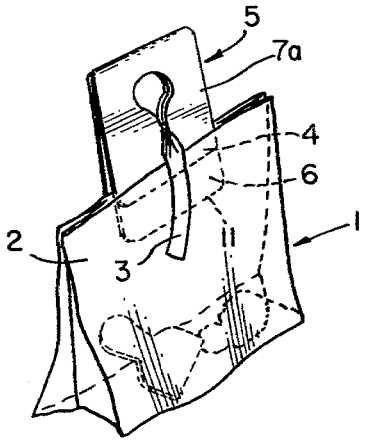
FIG. 4 is a perspective view showing the bag in FIG. 3 from behind.

After that the bag 1 is raised by pulling the binding means 3 upward. In this condition, the operator seizes the hold portion 7*b* of the scooper board 5, and turns it upwardly about the fixing part 4 formed at the edge 2*b* as shown in FIG. 2. By such an operation as above described, the guide portion 6 of the scooper board 5 fully enters in the bag body 2, and the hold portion 7*b* comes to the top position (FIG. 2). Then if the scooper board 5 is folded at the folding line 10 so as to make the hold portions *7a* and *7b* back to back each other, the holes 8*a* and 8*b* and the clamping portions 9*a* and 9*b* which can engage with binding means 3 accord with each other, and therefore, the binding means 3 can be pulled and engaged with the clamping portions 9*a* and 9*b* as shown in FIGS. 3 and 4. The user can take away with the bag 1 in his hand by inserting his fingers in the holes (8*a* and 8*b*).

Because the bag 1 of the present invention is constructed as above described, a plurality of bags can be carried, so if the dog (or pet animal) evacuates some times in one walk, a new bag can be taken out and used. And the bag is easy to operate because the mouth of the bag can be opened by only pulling the binding means 3 mounted of the edge 2*a* upward. Because the scooper board 5 can turn about the fixing portion 4 on which the scooper board is mounted, the guide portion 6 on which the droppings are put can be fully hold in the bag by turning the scooper board 5. And because the mouth of the bag 1 can be closed tightly by the hold portion *7a* *7b,* binding means 3 and clamping portions 9*a* and 9*b,* the droppings in the bag are prevented from rushing out of the bag. So the bag after used can keep a good sanitation. The bag of the present invention is produced so cheap that the bag holding the dog's droppings can be dumped as it is.

What is claimed is:

1. A bag for packaging anmial droppings made of a flexible material and having an open mouth with at least two edges at opposite sides of said mouth and a foldable fixing portion at one of said two edges of said mouth, comprising in combination therewith:

(a) a scooper board made of a hard material and having a guide portion fixed to said foldable fixing portion on the outside bag on one side thereof; and (b) binding means secured at the other of said two edges, opposite from where said scooper board is fixed so that said mouth will open when said binding means is pulled outwardly and so that said mouth will be closed tightly when said binding means is clamped to said scooper board;

wherein said scooper board has a length at least as long as the depth of said bag so that the scooper board will support said bag which is of flexible material when a user opens the mouth of the bag by pulling said binding means and positions said bag so that said mouth is near droppings to be picked up; and further wherein said scooper board has a hold portion extending from said guide portion so that said scooper board can be turned about said fixing portion and said guide portion can be placed within said bag.

2. A bag as defined in claim 1 wherein said scooper board includes a fold line in the middle of said hold portion to facilitate folding of said scopper board and closing said mouth of said bag.

3. A bag as defined in claim 2 wherein said scooper board includes two holes on opposite sides of said fold line, said two holes facilitating holding and being in accord or registration when said scooper board is folded about said fold line.

* * * * *